United States Patent [19]

Doramé et al.

[11] Patent Number: 4,655,236

[45] Date of Patent: Apr. 7, 1987

[54] PORTABLE CARPORT

[75] Inventors: Elizabeth S. Doramé, 8250 E. Rawhide Trail, Tucson, Ariz. 85715; Gilbert A. Doramé, Tucson, Ariz.

[73] Assignee: Elizabeth S. Doramé, Tucson, Ariz.

[21] Appl. No.: 751,059

[22] Filed: Jul. 2, 1985

[51] Int. Cl.[4] ..... E04H 15/06

[52] U.S. Cl. ..... 135/88

[58] Field of Search ..... 135/87, 88, 90, 95, 135/101, 104, 108, 114, 119; 188/32; 52/83

[56] References Cited

U.S. PATENT DOCUMENTS

| | | | |
|---|---|---|---|
| 1,528,629 | 3/1925 | Quinan et al. | 135/95 |
| 2,480,509 | 8/1949 | Ripley | 135/3 |
| 2,720,285 | 10/1955 | Taylor | 188/32 |
| 2,777,454 | 1/1957 | Kramer | 135/95 |
| 2,798,501 | 7/1957 | Oliver | 135/4 |
| 2,989,967 | 6/1961 | Lee | 135/1 |
| 3,036,583 | 5/1962 | Miller | 135/4 |
| 3,068,046 | 12/1962 | Bourgoin | 135/90 |
| 3,463,174 | 8/1969 | Heller | 135/1 |
| 4,200,115 | 4/1980 | Parker | 135/5 |

FOREIGN PATENT DOCUMENTS

| | | | |
|---|---|---|---|
| 2466369 | 4/1981 | Fed. Rep. of Germany | 135/90 |
| 65748 | 11/1969 | German Democratic Rep. | 135/88 |
| 147957 | 12/1979 | German Democratic Rep. | 135/88 |
| 875992 | 8/1961 | United Kingdom | 135/88 |

*Primary Examiner*—James R. Feyrer

*Attorney, Agent, or Firm*—Cahill, Sutton & Thomas

[57] ABSTRACT

A portable carport includes a foldable cover supported at its four corners by four telescoping assemblies each including an outwardly inclined telescoping mast. Each mast includes first and second anchoring legs, each having a foot wedged between the ground and the front and rear portions of the tread of the vehicle, respectively. A lateral anchoring assembly attached to each mast includes a lateral member having a plate which presses against an upper portion of the side wall of the adjacent tire and a clamp device that extends across the tread to engage the opposite inner wall of that tire and pulls the mast toward the tire, forcing the plate against the outer side wall, thereby maintaining the mast at a fixed angle of inclination relative to the plane of the tire. A removable spacer resting on the roof of the automobile pushes the center of the flexible cover upward to provide an air space between it and the top of the automobile. This allows rainfall to run off the top of the cover.

9 Claims, 13 Drawing Figures

FIG. 1
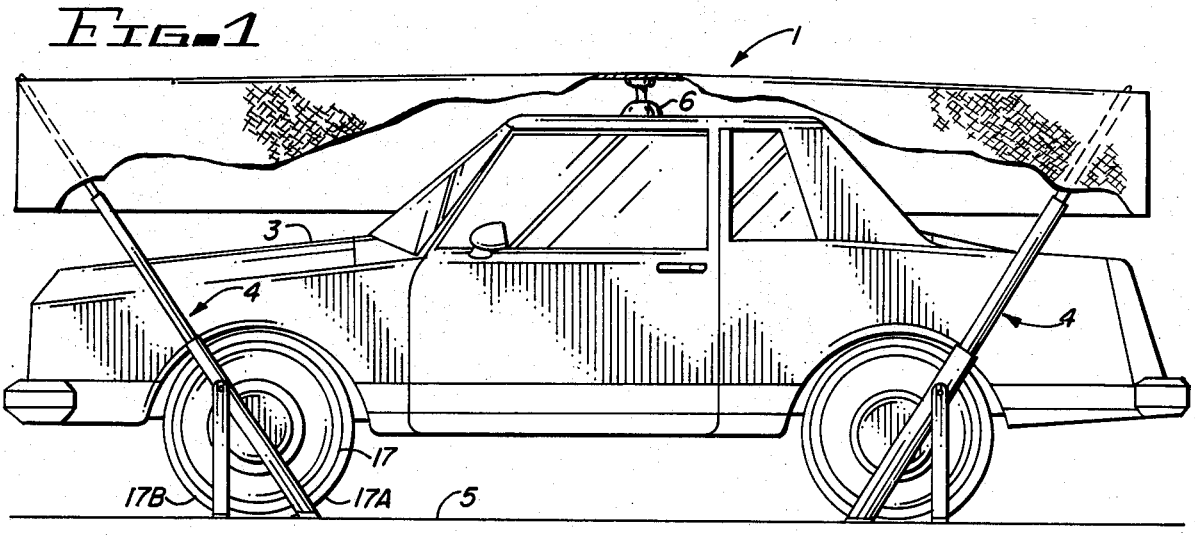
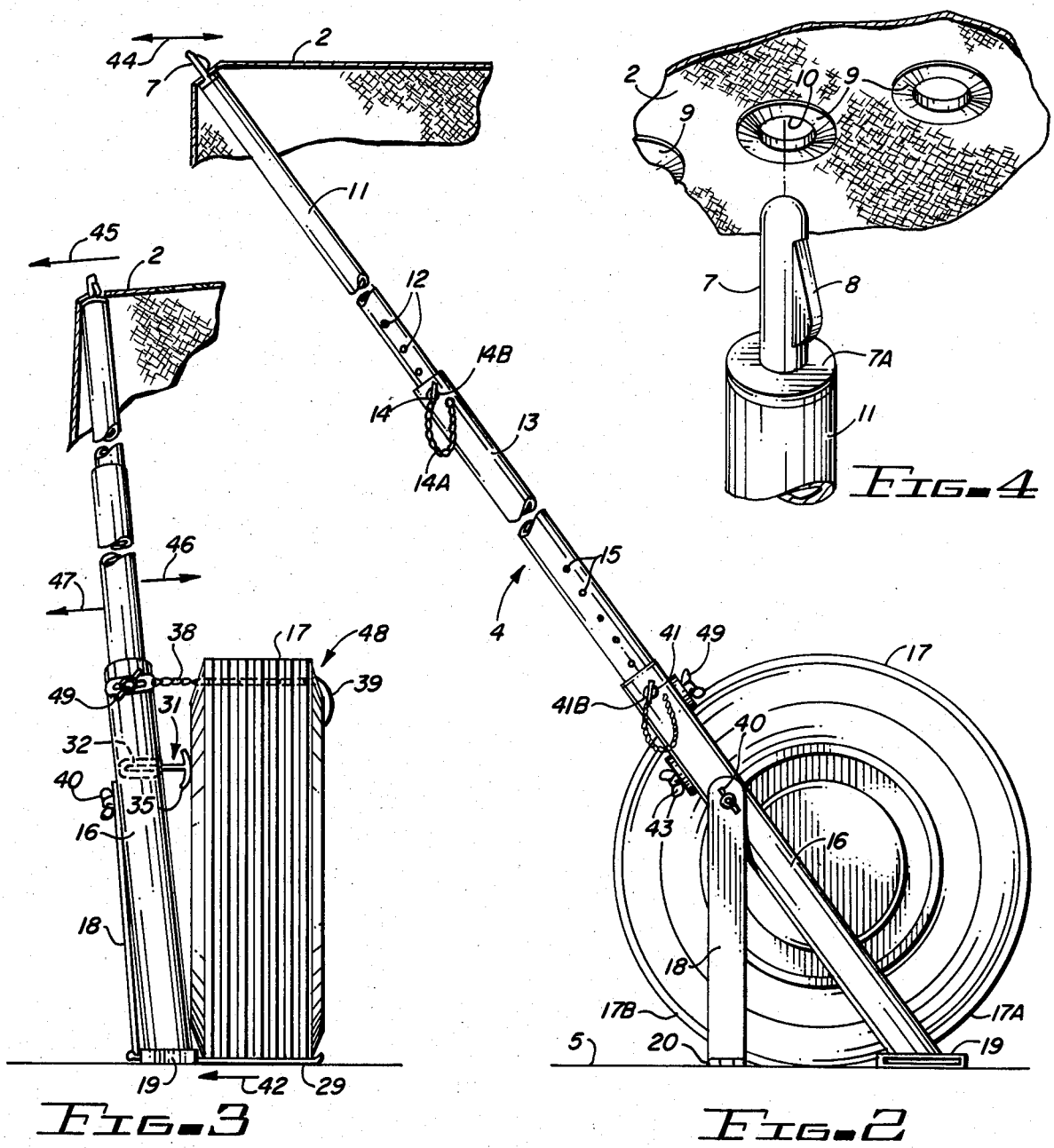
FIG. 4
FIG. 3
FIG. 2

PORTABLE CARPORT

BACKGROUND OF THE INVENTION

The invention relates to portable carports and the like which provide temporary shelters for automobiles, and particularly to portable carports of the type that do not require the tires of the vehicle to be driven onto a platform that anchors the device.

A variety of portable, temporary shelters or covers for automobiles are known, as protection of the interior of the automobile and also its painted surface from the elements, especially the hot sun. Some of the known devices, such as the one disclosed in U.S. Pat. No. 3,463,174, are elaborate, complex, and far too bulky to be kept in the trunk of the automobile and conveniently erected where needed to temporarily protect the automobile. U.S. Pat. Nos. 3,063,583 and 2,798,501 disclose collapsible, portable covers for automobiles that nclude a base on which the front wheels of the vehicle are driven; the base anchors an accordion-like frame about which a fabric cover unfolds in much the same fashion as an automobile convertible top unfolds from its retracted configuration. The devices of U.S. Pat. Nos. 3,063,583 and 2,798,501 also are too complex and bulky to be considered truly portable and are impractical for a person who desires an inexpensive, completely portable, easily erected cover for his automobile.

U.S. Pat. No. 4,200,115, British Pat. No. 875,992, and Dutch Pat. No. 147,957 disclose portable shelters or awnings which are quite simple in structure, but suffer from the shortcoming that they all include platforms onto which the vehicle must be driven in order to stabilize a frame structure over which a cloth cover or awning is stretched. It would be very desirable to have a device that can be completely installed without moving the car in order to anchor the device. Another shortcoming of the simple structure shown in U.S. Pat. No. 4,200,115, British Pat. No. 875,992 and Dutch Pat. No. 147,957 is that none of them provide adequate bracing in the directions transverse to the direction of travel of the automobile. Therefore, strong winds in the transverse direction could cause bending of the frame members that support the fabric cover.

Another shortcoming of many of the prior temporary car shelter structures is that they provide no degree of adjustability of the height and/or slope of the fabric cover, so the covers will have a tendency to form sagging pockets in which rainwater can collect.

SUMMARY OF THE INVENTION

Accordingly, it is an object of the invention to provide an improved portable carport which can be disassembled and easily transported, preferably in the trunk of the automobile which it is to cover, and which does not require that the wheels of the vehicle be driven onto an anchoring plate or support.

It is another object of the invention to provide an inexpensive, portable carport device which provides a high degree of structural strength and can withstand strong winds from any direction.

It is another object of the invention to provide a portable carport structure that is inexpensive, simple in structure, highly resistant to winds from any direction, and provides adjustability of the slope of a foldable cover supported by the frame of the device.

Briefly described, and in accordance with one embodiment thereof, the invention provides a portable carport including a foldable cover and four corner support assemblies each including an inclined, telescoping mast which supports the cover by engaging eyelets in the respective corners of the cover, wherein each of the corner support assemblies includes a leg or anchor attached to its lower end and wedged between the inner tread of a tire and the ground and a second leg attached to the telescoping mast and having an anchor wedged between the outer tread surface of the tire and the ground. A lateral force bearing member has an abutment plate attached to its inner end engaging an upper side wall portion of the adjacent tire, and is rigidly connected to the mast. A clamp attached to the mast extends around the tread surface of the tire and engages an upper inner side wall portion of the tire and draws the mast toward the tire, forcing the abutment plate against the outer sidewall and thereby rigidly anchoring the telescoping mast to the upper portion of the tire at a fixed angle to the plane of the tire, despite lateral forces applied to the cover and mast as a result of cross winds. A roof spacer placed on the roof of the car pushes the center portion of the cover upward. Each of the telescoping masts is adjustable in length, so the slope of the cover can be adjusted to allow runoff of rainwater. The portable carport can be disassembled and placed into the trunk of a typical automobile, and can be assembled after the automobile is parked without the need to move the automobile in order to anchor the portable carport. The described device protects the automobile from suin adn rain, and is sufficiently durable to avoid being damaged by fairly strong gusts of wind. Tear-away eyelets can be use to yield when wind forces on the foldable cover exceed a certain level to avoid damage to the cover support assemblies.

BRIEF DESCRIPTION OF THE DRAWINGS

FIG. 1 is a partial cutaway side elevational view of the portable carport of the present invention.

FIG. 2 is a side elevational view of one of the corner support assemblies of the portable carport shown in FIG. 1.

FIG. 3 is a partial elevational end view showing one of the corner assemblies and one tire of an automobile and the portable carport of FIG. 1.

FIG. 4 is an enlarged partial perspective view of the upper end of one of the corner support assemblies of the portable carport shown in FIG. 1.

DESCRIPTION OF THE INVENTION

Figure 13:
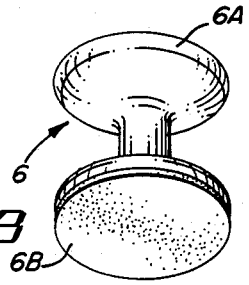
FIG. 13 is a perspective view of a roof spacer shown in the cutaway portion of FIG. 1.

Referring now to the drawings, especially FIG. 1, portable carport 1 includes a cover 2 having four corners that are supported by the upper ends of four corner support assemblies 4 to cover an automobile 3 which is resting on a ground surface 5. A roof spacer 6, which may have a magnetic bottom surface 6B (FIG. 13), has an upper rounded surface 64 that pushes the center portion of flexible cover 2 upward somewhat to enhance runoff of rainwater by preventing excessive sagging of the center of cover 2.

Figure 12:
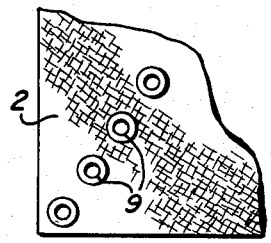
FIG. 12 is an enlarged view of detail 12 shown in FIG. 11.

As best seen in FIG. 4, the upper tip of each mast of the four corner support assemblies includes a protruding, narrowed diameter finger 7 that extends through an opening 10 of eyelet 9 in the material of cover 2. FIGS. 1 and 12 illustrate the configuration of cover 2 and indicate the corner locations of a plurality of diagonally aligned eyelets 9 in each corner. The plurality of diagonally aligned eyelets 9 in each corner portion of the cover allows the cover to be stretched over the upper ends of the masts of the corner assemblies 4 with a desired amount of tension.

A spring loaded retractable retainer 8 is depressed as finger 7 is inserted through eyelet 9, and springs open fter eyelet 9 slips down to shoulder 7A and thereby retains the eyelet on finger 7. Shoulder 7A is enlarged to support the rim of eyelet 9. The bottom portion of retainer 8 is rounded so that sufficient outward force on eyelet 9, for example due to wind forces on the cover 2, will result in eyelet 9 sliding outwardly over, and thereby depressing retainer 8.

Referring next to FIG. 2, it can be seen that finger 7 is supported on a first telescoping tube 11 having a plurality of pin-receiving holes 12 therein. Tube or Rod 11 slides into a second telescoping tube 13, which has a plurality of pin-receiving holes 15 therein. The lower end of tube 15 slides into a lower tube or leg 16.

A pin 14 connected to a chain 14A is inserted into a hole 14B of the tube 13 aligned with one of the pin-receiving holes 12 and is also inserted through that hole 12, to thereby rigidly attach tube 11 to tube 13. Tube 13 is similary rigidly attached as an extension of tube 16 by means of pin 41, which is attached to a chain 41A and extends through a hole 41B in tube 16 and into an aligned one of the pin-receiving holes 15.

The lhree lubes 11, 13, and 15 are collectively referred to as a "mast", when extended as illustrated in FIGS. 1 and 2.

Figure 5:
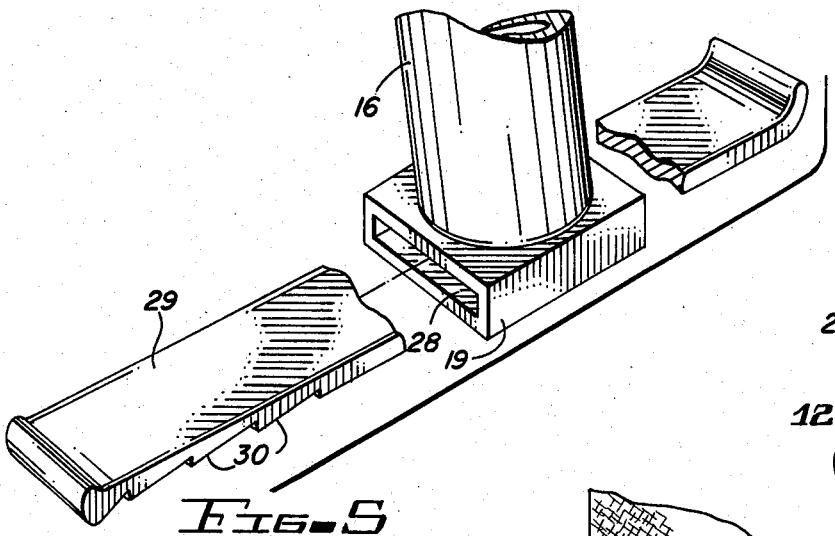
FIG. 5 is a partial perspective view of the lower or leg end of the telescoping mast of the corner support assembly shown in FIG. 2.
Figure 11:
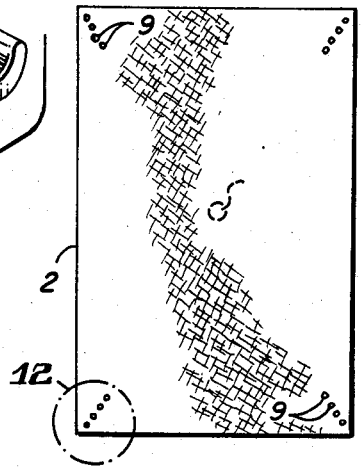
FIG. 11 is a plan view of the cover of the portable carport shown in FIG. 1.

A slotted base 19 is rigidly attached to the bottom end of leg 16 and rests flat on ground surface 5. A foot 29 extends through elongated slot 28 in base 19, and extends underneath the inner tread surface of tire 17, and is wedged between that inner tire surface 17A and ground surface 5. As best seen in FIG. 5, a plurality of teeth 30 are provided on the bottom surface of foot 29 to prevent slippage in the direction of arrow 42 in FIG. 3.

Figure 6:
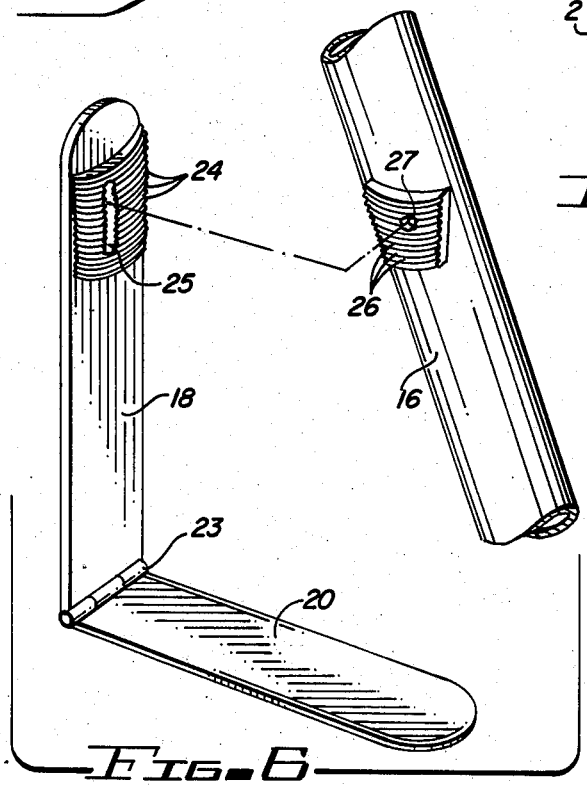
FIG. 6 is a partial exploded view illustrating the connection between an anchoring leg and one section of the leg end of the mast shown in FIG. 2.

A vertical secondary leg 18 is attached by means of a wing nut 40 to the side of primary leg 16, as best seen in FIGS. 2 and 3. Referring next to FIG. 6, it can be seen that leg 18 has a foot 20 connected to its lower end by means of hinge 23. Foot 20 extends inwardly under automobile 3, and is wedged between the outer or front tread surface 17B of tire 17 and ground surface 5. The two feet 29 and 20 wedged between ground surface 5 and tire 17 securely anchor the mast 11, 13, 16 to the ground and/or tire 17.

A plurality of arcuate grooves and ribs 24 are provided on the inner upper surface of leg 18 to mesh with mating grooves and ribs 26 that are attached to the side surface of leg 16. Wing nut 40 and a bolt (not shown) draws the upper end of leg 18 and grooves and ribs 24 into meshing engagement with grooves and ribs 26 of leg 16, preventing any rotation of leg 18 relative to legs 16. A bolt (not shown) extending through hole 27 of legs 16 and slot 25 of leg 18 allows adjustment of the position of leg 18 and allows wing nut 40 to rigidly attach the upper end of leg 18 to leg 16, as shown.

It can be seen that the corner assembly 4 thus is anchored by the weight of automobile 3 and strongly resists forces applied to the upper ends of the corner support assemblies 4 in the directions of arrows 44 in FIG. 2.

Figure 9:
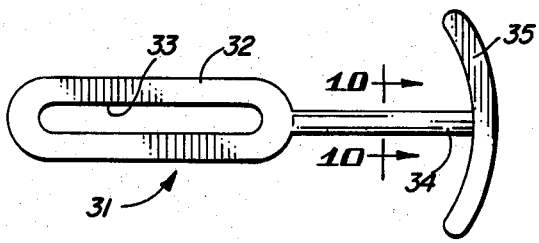
FIG. 9 is a plan view of lateral force bearing member of the device as shown in FIG. 3.

In order to provide effective bracing against transverse forces in the directions of arrows 45 in FIG. 3, due to cross winds, a thrust member 31 (FIGS. 3 and 9) is attached to a front or rear surface of leg 16 by means of a wing nut 43 threaded onto a bolt (not shown) extending through an elongated slot 33 in a loop 32, thereby anchoring loop 32 to leg 16. Thrust member 31 includes a rod 34 attached at one end to loop 32 and attached at its other end to the center of an abutment plate 35. Abutment plate 35 is positioned to press against the outer sidewall of the upper portion of tire 17, and resists tilting of the mast 11, 13, 16 in the direction of arrow 46 in FIG. 3. As mentioned before, the weight of tire 7 on foot 20 and foot 29 prevents the bottom of corner support assembly 4 from slipping in the direction of arrow 42 in FIG. 3.

Figure 7:
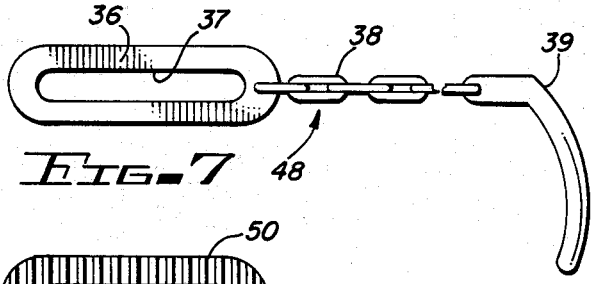
FIG. 7 is a plan view of the clamp mechanism of the device as shown in FIG. 3.

In order to prevent mast 11, 13, 16 from tilting in the direction of arrow 47 in FIG. 3, a clamping assembly 48 (FIG. 7) is provided, including a loop 36 with an elongated slot 37 therein attached by means of a threaded bolt or stud (not shown) and a wing nut 49 (FIGS. 2 and 3) to the upper portion of leg 16, a chain 38 connected to the right end of loop 36, and a clamp plate 39 that extends along the outer tread surface of tire 17 and around the inner sidewall of tire 17. The elongated slot 36 and wing nut 49 and the bolt (not shown) to which wing nut 49 is attached allows adjustment of the tension on chain 38. The combined action of clamping assembly 48 and thrust member 31 rigidly anchors corner support assembly 4 to the upper portion of tire 17, accomplishing the objective of preventing excessive transverse movement of the upper end of rod 11 in the directions of arrows 45 (FIG. 3).

Figure 10:
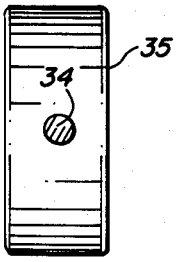
FIG. 10 is a section view taken along section line 10—10 of FIG. 9.

FIG. 10 shows the broad rounded outer surface of abutment plate 35.

Figure 8:
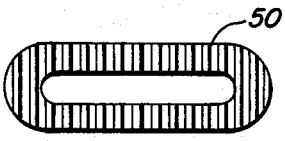
FIG. 8 is a plan view of a ribbed reverse surface of the clamping device shown in FIG. 7.

Slippage of the loop 32 of thrust member 31 relative to leg 16 is avoided by provision of a "ribbed" back surface such as 50 shown in FIG. 8 on loop 32. A similar surface is provided on the outer surface of leg 16. Slippage of loop 36 of clamping assembly 48 is similarly avoided.

The above-described portable carport is easily erected. An adult can erect it in approximately five minutes after stopping the automobile by removing the parts from the trunk of the automobile and removing them from their container. Next, the following procedure is performed for each of the four telescoping tube assemblies. First, the foot 29 is slid into the slot 28 at the base of each mast 16 (FIG. 5). The foot 29 is slipped under the inner tread surface 17A of the appropriate tire of the automobile. The leg 18, with its foot 20 lowered and extended underneath the automobile, and with nut 40 loosened slightly, is positioned so that the foot 20 is wedged beneath the outer tread surface 17B of the tire and the ground. The leg 16 and the leg 18 are manipulated so that both the foot 29 and the foot 20 are firmly wedged between the tire surface and the ground surface. Thrust member 31 (FIGS. 3 and 9) is adjusted against the outer sidewall of tire 17 so that the mast is approximately 2 inches from the outer edge of the top of the fender well of the automobile (not shown). Next, the clamp 48 (FIGS. 3 and 7) is adjusted so that it extends over the top of the tire and pulls the mast inward so that thrust member 31 presses against the outer sidewall surface of the tire 17.

Next, the correct height of each mast is obtained by inserting pins 14 and 41 in the desired pin receiving holes. The cover 2 can be easily raised to cover the car and the appropriate eyelets 9 can be positioned over the pegs 7 on the upper end of each corner support assembly 4 to produce the desired tension or tautness of cover 2. The roof spacer 6 can be positioned to raise the peak of cover 2 above the roof of the car.

Preferably, the tubes 11, 13, and 15 can be composed of aluminum tubing. In the prototype embodiment of the invention, tube 11 is aluminum extruded material having an outside diameter of 0.875 inches and an inside diameter of 0.499 inches. Tube 13 is aluminium extruded material, having an inside diameter of 0.938 inches and an outside diameter of 1.25 inches. Leg 16 is composed of the same material, and has an inside diameter of 1.313 inches and an outside diameter of 1.625 inches. Cover 2 can be composed of sail cloth. A variety of other materials than those indicated above can also be used.

The above-described portable carport 1 can be quickly erected without moving the car after it has been stopped. The portable carport as described above has great structural strength and can effectively resist high winds of at least 25 miles per hour from any direction. Use of stronger material can increase the strength. The eyelets 9 can be attached so that they will tear out if the wind force on the cover exceeds a certain level, in order to avoid bending the masts. The lengths of the different erected corner support assemblies 4 can be adjusted to provide a sloped roof surface which allows runoff of rain. Disassembly of the portable carport is the reverse of assembly, and is equally easy.

While the invention has been described with reference to a particular embodiment thereof, those skilled in the art will be able to make various modifications to the disclosed embodiment without departing from the true spirit and scope thereof. For example, it is not always essential that clamping member 48 be utilized, as its function can be at least partially performed by the inward forces produced by cover 2 on the outer ends of each of the masts of the corner support assemblies. However, if exceptionally strong winds are expected, then the clamping assemblies 48 should be used. Other types of assemblies than the one described above could be used to anchor the masts to the upper and lower portions of the automobile tires.

What is claimed is:

1. A portable carport comprising:

(a) a foldable cover having four corners;

(b) four corner support assemblies for supporting the four corners of said cover above an automobile having four tires, each of said corner support assemblies including i. first anchoring means for anchoring that corner support assembly to an inner tread surface of one of the tires; and ii. second anchoring means for anchoring that corner support assembly to an outer tread surface of that tire, the weight of the car on that tire effectively anchoring that corner support assembly and securely supporting of one corner of said cover above the automobile, wherein each of said corner support assemblies includes a mast connected to the first and second anchoring means of that corner support assembly, and wherein each of said corner support assemblies includes upper anchoring means for anchoring that corner support assembly to an upper portion of one of the tires to maintain a fixed angle between tha mast of that corner support assembly and the plane of the adjacent tire;

wherein said upper anchoring means includes a lateral member, an abutment plate attached to an inner end of said lateral member for abutment against the outer wall of an upper portion of one adjacent tire, and means for rigidly attaching an outer end portion or said lateral member to said mast, and wherein said upper anchoring means includes a clamping means for extending around the tread of the tire and engaging an inner wall of the upper portion of that tire and pulling the mast toward that tire, urging the abutment plate against the outer wall of the tire.

2. The portable carport of claim 1 wherein the first anchoring means of each of said corner support assemblies includes a horizontal member wedged between a ground surface and the inner tread surface of an adjacent tire.

3. The portable carport of claim 2 wherein said first anchoring means of each corner support assembly is rigidly attached to the mast thereof.

4. The portable carport of claim 3 wherein said second anchoring means of each corner support assembly is connected to the mast thereof at a predetermined angle thereto.

5. The portable carport of claim 4 wherein each of said masts includes a plurality of telescoping tubes.

6. The portable carport of claim 5 wherein each of the corners of said cover includes an eyelet, wherein each of said masts has a narrow finger extending from a shoulder and extending through one of said eyelets.

7. The portable carport of claim 6 wherein each of said corner support assemblies includes adjustable locking means for locking the telescoping tubes thereof to a plurality of predetermined lengths.

8. The portable carport of claim 7 including roof spacer means for holding a central portion of the cover a predetermined distance above the roof of the car to cause rain to run off of the cover.

9. The portable carport of claim 6 including a plurality of eyelets in each corner of said cover and aligned along diagonals of said cover, whereby the eyelet selected in each corner for insertion of said finger is selected to achieve a desired tautness of said cover.

* * * * *